US007425146B2

(12) United States Patent
Valentin

(10) Patent No.: US 7,425,146 B2
(45) Date of Patent: Sep. 16, 2008

(54) LOCK-ON BOOT

(75) Inventor: William R. Valentin, Meriden, CT (US)

(73) Assignee: Hubbell Incorporated, Orange, CT (US)

( * ) Notice: Subject to any disclaimer, the term of this patent is extended or adjusted under 35 U.S.C. 154(b) by 29 days.

(21) Appl. No.: 11/367,751

(22) Filed: Mar. 6, 2006

(65) Prior Publication Data

US 2007/0207645 A1 Sep. 6, 2007

(51) Int. Cl.
*H01R 13/62* (2006.01)

(52) U.S. Cl. ..... 439/304; 439/369

(58) Field of Classification Search ..... 439/133, 439/304, 367, 368, 369, 372, 373; 285/373
See application file for complete search history.

(56) References Cited

U.S. PATENT DOCUMENTS

| | | | | |
|---|---|---|---|---|
| 804,387 | A | 11/1905 | Davis | |
| 3,344,393 | A | 9/1967 | Hendee | |
| 4,169,643 | A | 10/1979 | Gallagher | |
| 4,391,458 | A * | 7/1983 | Blakeley | 285/112 |
| 4,443,047 | A | 4/1984 | Hofmann | |
| 5,052,939 | A * | 10/1991 | Koch | 439/133 |
| 5,135,409 | A | 8/1992 | Thompson | |
| 5,139,429 | A | 8/1992 | Herman et al. | |
| 5,338,211 | A * | 8/1994 | Kodama et al. | 439/135 |
| 5,393,243 | A | 2/1995 | Carmo | |
| 5,620,210 | A * | 4/1997 | Eyster et al. | 285/81 |
| 5,755,588 | A | 5/1998 | Sweatman et al. | |
| 5,816,853 | A * | 10/1998 | Buekers et al. | 439/521 |
| 6,149,445 | A * | 11/2000 | Daddono | 439/133 |
| 6,250,946 | B1 * | 6/2001 | Tardy | 439/367 |
| 6,602,087 | B1 | 8/2003 | Carle | |
| 6,745,437 | B2 * | 6/2004 | Gremillion, III | 16/413 |
| 6,913,294 | B2 * | 7/2005 | Treverton et al. | 285/406 |
| 2003/0157826 | A1 | 8/2003 | Moreno et al. | |

* cited by examiner

*Primary Examiner*—Thanh-Tam T Le
(74) *Attorney, Agent, or Firm*—Jenae C. Avallone; Mark S. Bicks; Alfred N. Goodman

(57) ABSTRACT

A lock-on boot for preventing a double-ended cable from becoming detached from a motor disconnect switch, includes a cover, a retaining rail, a locking mechanism, and a hinge. The cover has two convexly curved shells, each with an inner wall, an interior end, and an exterior end. The retaining rail is mounted on the inner walls within the convexly curved shells for dividing the shells into first and second pockets. The locking mechanism secures the convexly curved shells together and protrudes along their exterior ends. The hinge extends along the convexly curved shells pivotally joining their interior ends so that the convexly curved shells are movable between open and closed positions.

19 Claims, 4 Drawing Sheets

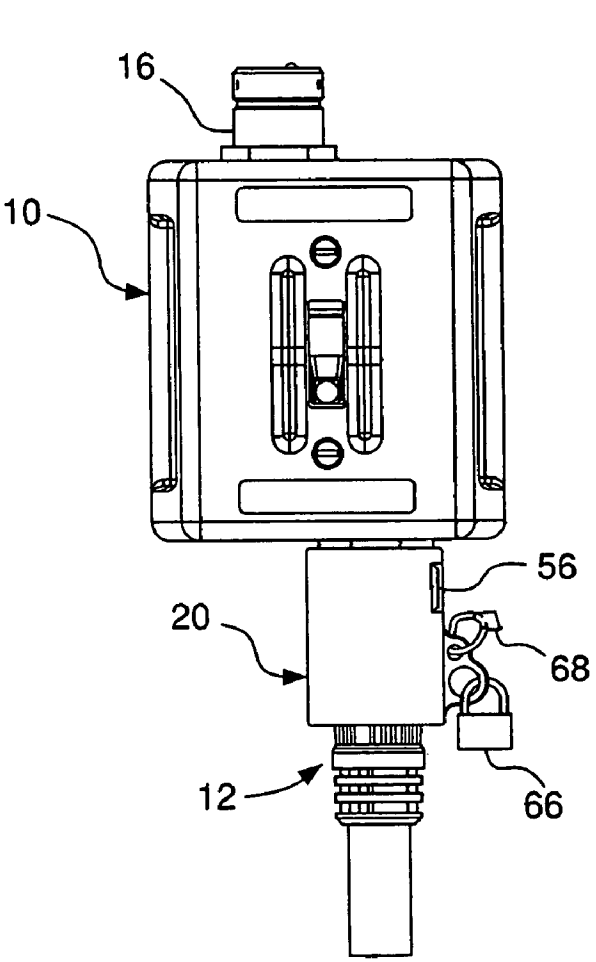
FIG. 1
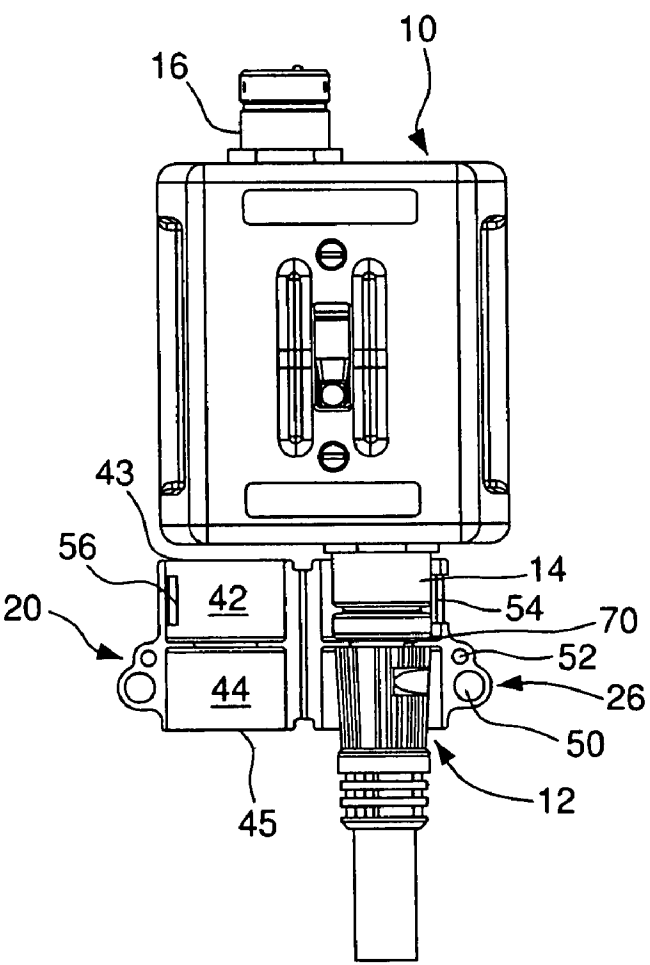
FIG. 2
FIG. 3

LOCK-ON BOOT

FIELD OF THE INVENTION

The present invention relates to a lock-on boot designed to be applied over electrical cables, specifically with respect to cables connected to motor disconnect switches. More particularly, the invention relates to a lock-on boot comprising a cover, a retaining rail, a locking mechanism, and a hinge. The lock-on boot can be used with a Linkosity™ system. Linkosity™ is a registered trademark of Lockheed Martin Corporation.

BACKGROUND OF THE INVENTION

Conventional electrical cable covers have been designed to secure electrical plugs into an outlet or to another plug. An electrical cable cover typically includes a first half male portion and a first half female portion, hinged together and movable between open and closed positions. They are commonly sized to receive a portion of a connected electrical plug and a socket therein. Some of these cable covers are used in power systems.

A power system can include pre-configured, factory-manufactured assemblies that can be easily installed as a cost effective alternative to conventional distribution methods. Plug-and-play architecture and re-usability drastically reduces the total cost of ownership of electrical power systems. With plug-and-play architecture, a number of wires are fed into a system with one major cable. There is a risk that the major cable will become disconnected from the system when an unauthorized person tampers with it. Since the entire system is dependent on only one receptacle threadedly engaged by a cable feeding into that receptacle, an interference with the connection, such as someone pulling them apart, would disrupt the entire system.

Accordingly, a need exists for providing a unique and improved electrical cable cover for securely protecting a cable cord, specifically a Linkosity™ cable. Further, there exists a need for simultaneously precluding its disconnection from an outlet. This need is particularly acute in plug-and-play techniques when one cable controls the power sourcing for a plurality of wires traveling to and from a unit.

SUMMARY OF THE INVENTION

Accordingly, an object of the invention is to provide an electrical cable cover such as a lock-on boot designed to fit over cables.

Another object is to provide a lock-on boot for use with plug and play configurations.

A further object is to provide a polypropylene clamshell type safety cover designed to fit over Linkosity™ cable systems.

Yet another object is to provide a lock-on boot comprising an interior restraining wall for gripping a cable connector and preventing the lock-on boot from moving back and forth over the cable and a power receptacle once the cover is attached.

Still another object is to provide a lock-on boot connected at one end with a hinge and at an opposite end with a cantilever snap that can only be opened with a tool, and a locking mechanism to further secure the ends of the lock-on boot.

The foregoing objects are basically attained by providing a lock-on boot comprising a cover, a retaining rail, a locking mechanism, and a hinge. The cover has first and second convexly curved shells, and an inner wall. The first and second convexly curved shells have an interior end, and an exterior end. The retaining rail is mounted on the inner wall of the cover, and extends within the first and second convexly curved shells for dividing the shells into first and second pockets. The locking mechanism secures the first and second convexly curved shells together protruding along exterior ends thereof. The hinge extends along the first and second convexly curved shells pivotally joining the interior ends thereof so that the first and second convexly curved shells are movable between open and closed positions.

By forming the lock-on boot in this manner, end users without accessibility privileges would be prevented from unlocking the security device(s) attached to the boot covering the Linkosity™ cables. The retention of the lock-on boot is further enabled by the cantilever snap that hooks the second convexly curved shell into the first convexly curved shell and can only be unhooked with a tool.

As used in this application, the terms "top", "bottom", and "side" are intended to facilitate the description of the lock-on boot, are merely illustrative of the lock-on boot and are not intended to limit the lock-on boot of the present invention to any particular orientation.

Other objects, advantages and salient features of the invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 1 is a front, elevational view of the motor disconnect switch with the double-ended cable and male and female receptacles attached in accordance with a first embodiment of the present invention;

FIG. 2 is a front, elevational view of the motor disconnect switch of FIG. 1 with the lock-on boot according to an embodiment of the present invention in an open position;

FIG. 3 is a front, elevational view of the motor disconnect switch and lock-on boot of FIG. 2 in a closed position;

DETAILED DESCRIPTION OF THE INVENTION

Figure 4B:
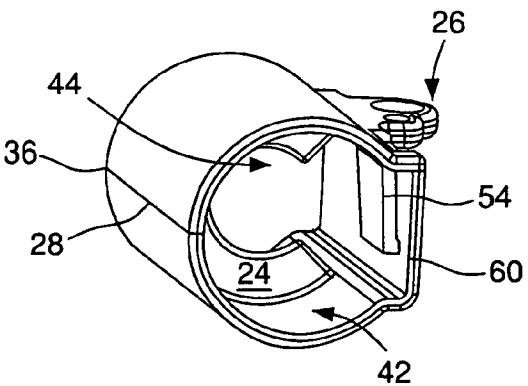
FIGS. 4*a*, 4*b* are side, perspective views of the lock-on boot of FIG. 3 showing the locking mechanism and interior of the cover.

As seen in FIG. 1, a motor disconnect switch 10 is supplied with power via a double-ended cable 12. The double-ended cable 12 is typically coupled at a bottom of the motor disconnect switch 10, to a female receptacle 14 where power flows into the motor disconnect switch 10. At this junction, power is routed through the motor disconnect switch 10 and exits from the motor disconnect switch 10 through the male receptacle 16.

To prevent the cable 12 from becoming detached from the female receptacle 14, and ultimately from the motor disconnect switch 10, a lock-on boot 20, according to a first embodiment of the present invention, is attached around the cable 12 and the female receptacle 14, as seen in FIG. 2. The cable 12 and receptacle 14 are threaded together and this connection is secured by lock-on boot 20. The only way for the cable 12 and receptacle 14 to be disconnected would be for someone to manually unthread the cable 12 from the receptacle 14.

The lock-on boot is designed to universally clamp onto different Linkosity™ connections. There can be multiple arrangements for securing the lock-on boot 20 to the cable 12. It is possible to attach the lock-on boot 20 around (1) a cable and a male receptacle, (2) male and female cable cords, or (3) Linkosity™ accessories such as tees and pass-thrus. For purposes of illustration, only the connection between the male cord and female receptacle will be described.

In FIG. 2, the lock-on boot 20 is positioned, and is about to be closed in anticipation of being locked around the cable 12 and the female receptacle 14 to prevent the cable 12 from moving away from its connection with the female receptacle 14. The lock-on boot 20 is a polypropylene clamshell type safety cover designed to fit over cables for use with the Linkosity™ system in plug-and-play configurations.

Figure 4A:
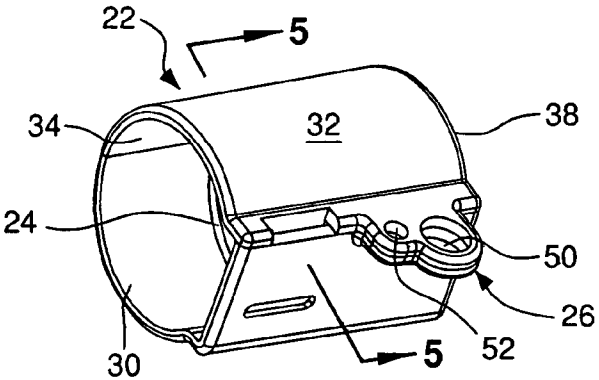

As seen in FIGS. 4*a* and 4*b*, the lock-on boot 20 comprises a cover 22, a retaining rail 24, a locking mechanism 26, and a hinge 28. The cover 22 has first and second convexly curved shells 30, 32, and an inner wall or surface 34. The first and second convexly curved shells 30, 32 have interior ends 36, and exterior ends 38. The locking mechanism 26 secures the first and second convexly curved shells 30, 32 together protruding along exterior ends 38 thereof. The hinge 28 extends along the first and second convexly curved shells 30, 32 pivotally joining the interior ends 36 thereof so that the first and second convexly curved shells 30, 32 are movable between open and closed positions.

The retaining rail 24 is mounted along the inner wall 34 of the cover 22, extending radially inwardly along the inside of the first convexly curved shell 30 and the second convexly curved shell 32. The retaining rail 24 is substantially C-shaped and follows the arc of the first and second convexly curved shells 30, 32. The purpose of the substantially C-shaped retaining rail 24 is to allow debris and liquids to pass through the lock-on boot 20 rather than collecting in the pockets 42, 44. Retaining rail 24 extends along the width of the first and second convexly curved shells 30, 32 separating each convexly curved shell 30, 32 into two separate sections, first and second pockets 42, 44, as seen in FIG. 2. The thickness of the retaining rail 24 in the axial direction of the curved shells 30, 32 is substantially equal to the thickness of the shells 30, 32.

First pocket 42 includes a portion of first convexly curved shell 30 and the corresponding portion of second convexly curved shell 32 directly opposite first convexly curved shell 30 between the retaining rail and boot axial end 43. In other words, it is the section directly opposite the hinge 28. Similarly, second pocket 44 includes that portion of first convexly curved shell 30 not included in the first pocket 42 and that portion of second convexly curved shell 32 not included in the second pocket 44, i.e. between retaining rail 24 and boot axial end 45. Pockets 42, 44 will encase the female receptacle 14 and the double-ended cable 12, respectively.

Figure 6:
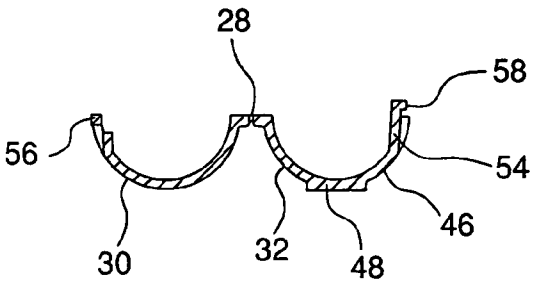
FIG. 6 is an end elevational view in cross section of the lock-on boot taken along line 6-6 of FIG. 8.
Figure 7B:
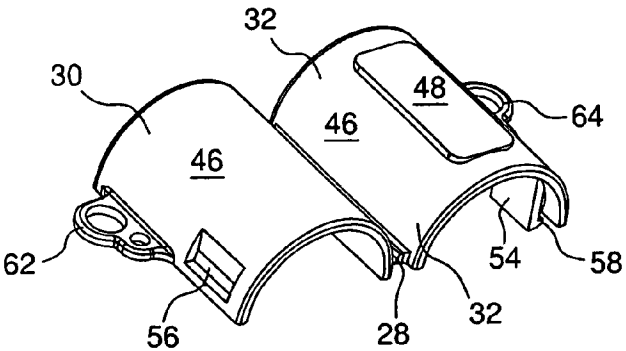
FIGS. 7*a*, 7*b* are side, perspective views of the lock-on boot in FIG. 2 showing the base.
Figure 7A:
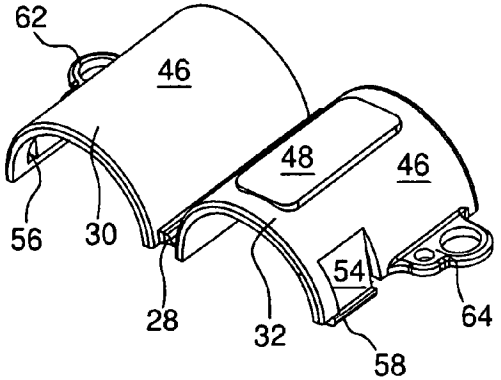
Figure 9:
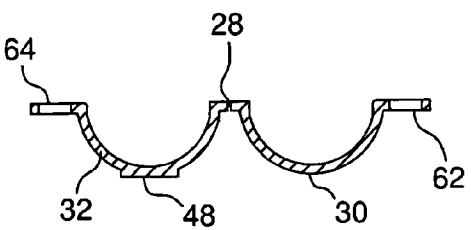
FIG. 9 is a side, elevational view in cross-section of the lock-on boot taken along line 9-9 of FIG. 8.

Turning to FIG. 7*a*, the second convexly curved shell 32 comprises a substantially flat base 48 formed along and extending radially outwardly from its outer wall or surface 46. This base 48 is suitable for printing an identification label on a flat, planar surface of the lock-on boot 22, as seen in FIGS. 6 and 9. Base 48 can be substantially rectangular in shape, having a length proportionally larger than its width, as depicted in FIGS. 7*a* and 7*b*. Optionally, the first convexly curved shell 30 can comprise the base 48 formed along and extending radially outwardly from its outer wall or surface 46.

Figure 8:
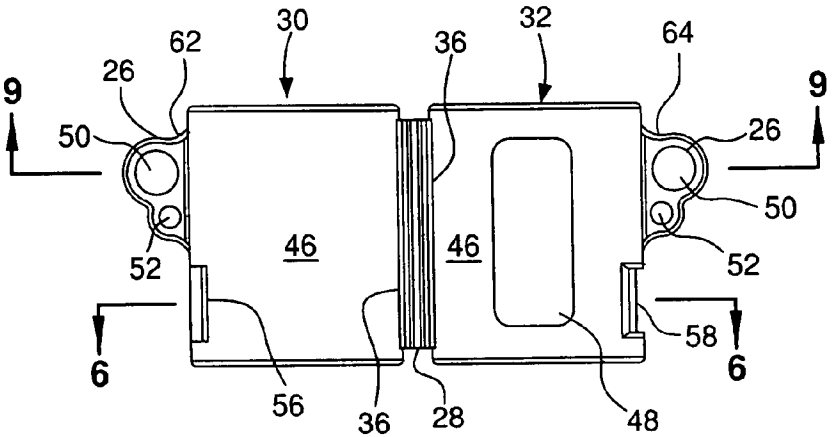
FIG. 8 is a top plan view of the lock-on boot in FIG. 2 showing the living hinge.
Figure 11:
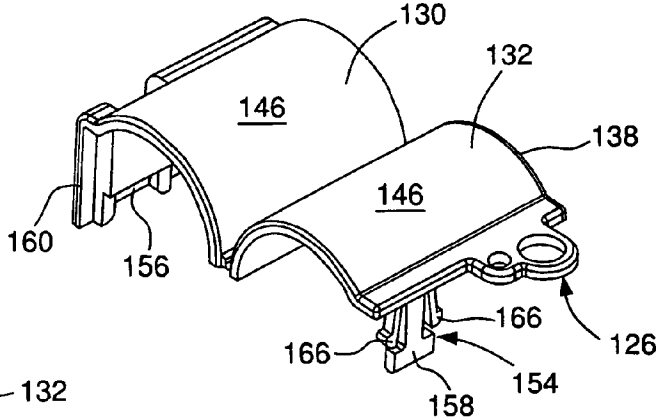
FIG. 11 is a side, perspective view of the lock-on boot in FIG. 10 showing the cantilever snap.
Figure 14:
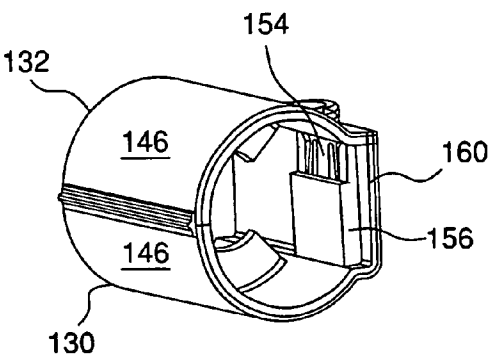
FIG. 14 is a side, perspective view of the lock-on boot of FIG. 10 showing the cantilever snap engaged with the compartment.
Figure 12:
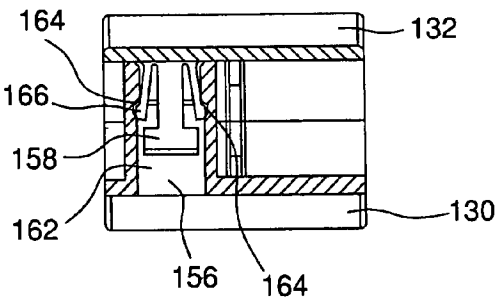
FIG. 12 is an inside, perspective view in cross section of the lock-on boot taken along line 12-12 of FIG. 13.
Figure 10:
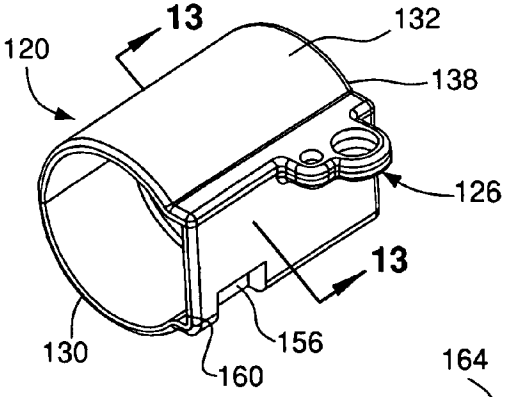
FIG. 10 is a side, perspective view of the lock-on boot in accordance with a second embodiment of the present invention.
Figure 13:
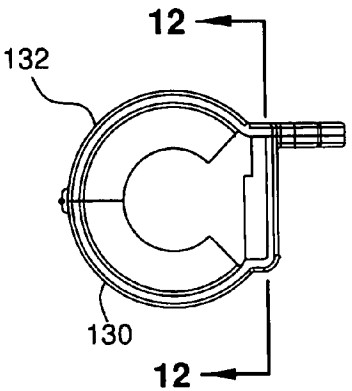
FIG. 13 is an end elevational view in cross section of the lock-on boot taken along line 13-13 of FIG. 10.

The locking mechanism 26 for securing the first and second convexly curved shells 30, 32 to each other is divided into mating ends, as seen in FIG. 8. One of the mating ends 62 is attached to the exterior end 38 of the first convexly curved shell 30 and the other mating end 64 of the locking mechanism 26 is attached to the exterior end 38 of the second convexly curved shell 32. The locking mechanism 26 further comprises first and second substantially-circular openings 50, 52 on each of the mating ends. The mating ends are positioned such that when the first and second convexly curved shells 30, 32 line up around the double-ended cable 12, the first and second substantially-circular openings 50, 52 of both sides of cover 22 are aligned.

The locking mechanism 26 protrudes radially outwardly from the double-ended cable 12 end so as not to interfere with covering the double-ended cable 12. The larger of first and second substantially-circular openings 50, 52, in this case, first substantially-circular opening 50 receives a padlock 66 in each of its mating ends to further secure the lock-on boot 20 in a closed position, as seen in FIG. 3.

The smaller of first and second substantially-circular openings 50, 52, in this case, second substantially-circular opening 52 receives a tag 68 in each of its mating ends. The tag 68 can be used for identification purposes notifying users of the specifications of the double-ended cable 12 and/or the motor-quick switch 10, etc. It is possible to substitute an additional padlock 66 in place of a tag 68 in second substantially-circular opening 52, if for some reason, a tag 68 is not used.

As illustrated in FIGS. 7*a*, 7*b*, and 8, a hinge 28 extends along the interior ends 36 of the first and second convexly curved shells 30, 32. The hinge 28 is a living hinge because it develops an orientation of the polypropylene molecules that it comprises. Consequently, this yields high strength and fatigue endurance. Premature failure can often be avoided with a living hinge 28 because it is comprised of polypropylene resins and does not rely on a pin threaded through its body.

The hinge 28 illustrated in FIGS. 7*a*, 7*b*, and 8 pivotally joins the first and second convexly curved shells 30, 32 so that the interior ends 36 thereof are movable between open and closed positions. This structure proves useful when the lock-on boot 20 is clamped around the double-ended cable 12 and female receptacle 14.

In addition to the locking mechanism 26 as described above, the exterior ends 38 of the first and second convexly curved shells 30, 32 opposite the hinge 28 are further secured by a cantilever snap 54, as seen in FIG. 7*a*. Cantilever snap 54 is a tangential extension of exterior end 38 of the second convexly curved shell 32, adjacent the locking mechanism 26. It is an elongated arm that includes the exterior end 38 of the second convexly curved shell 32 and a flanged portion 58 for locking into an inlet 56. Cantilever snap 54 secures the first and second convexly curved shells 30, 32 together such that the only way to separate them would be with a tool such as a flat-headed screwdriver. It is a rigid piece that protects the first and second convexly curved shells 30, 32 from separating on the exterior ends because cantilever snap 54 hooks into an inlet 56 in the first convexly curved shell 30.

Figure 5:
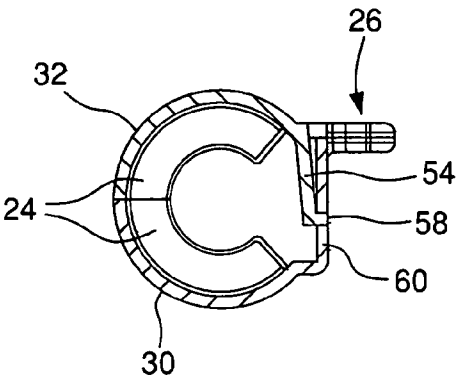
FIG. 5 is an end elevational view in cross section of the lock-on boot taken along line 5-5 of FIG. 4*a;*

First convexly curved shell 30 comprises a flat bar 60 which is an extension of the outer shell closest to the exterior end 38 of first convexly curved shell 30. The flat bar 60 radially extending from the first convexly curved shell 30 comprises the inlet 56, seen in FIGS. 4*b* and 5, which receives the cantilever snap 54. Cantilever snap 54 engages the inlet 56, illustrated in FIG. 5, of first convexly curved shell 30. The inlet 56 is slotted enough through the surface of first convexly curved shell 30 to receive the flanged portion 58 of cantilever snap 54. Thus, exterior ends 38 of first and second convexly curved shells 30, 32 are latched when the cantilever snap 54 couples to the inlet 56 and the flat bar 60 of first convexly curved shell 30 overlays the cantilever snap 54.

In a second embodiment illustrated in FIGS. 10-14, a lock-on boot 120 comprising first and second convexly curved shells 130, 132 includes a cantilever snap 154 to couple and secure the exterior ends 138 of the first and second convexly curved shells 130, 132. Cantilever snap 154 is a tangential extension of exterior end 138 of the second convexly curved shell 132, adjacent the locking mechanism 126. It is an elongated arm that divides into a T-bar 158 and two oppositely disposed hooks 166 for engaging a compartment 156. Bar 158 is tapered on its free end. Once the convexly curved shells 130, 132 are rotated towards each other, the end portions of the hooks 166, furthest from the body of second convexly curved shell 132, move away from the T-bar 158 to engage the lower corners 164 of compartment 156.

Similar to the first embodiment, cantilever snap 154 secures the first and second convexly curved shells 130, 132 together such that the only way to separate them would be with a tool such as a flat-headed screwdriver. T-bar 158 fits into the casing 162 of compartment 156 and hooks 166 fit into the corners 164 of compartment 156 in the first convexly curved shell 130. The hooks 166 are separate, shorter bars than the T-bar 158 angularly disposed so the end portions point and are biased away from T-bar 158. The hooks 166 control the total width of the cantilever snap 154 when they engage the corners 164 of compartment 156 because they spring out from the middle of T-bar 158.

First convexly curved shell 130 comprises a flat bar 160 which is an extension of the outer shell closest to the exterior end 138 of first convexly curved shell 130. The flat bar 160 radially extending from the first convexly curved shell 130 comprises the compartment 156, seen in FIGS. 12 and 14, which receives the cantilever snap 154. Cantilever snap 154 engages the compartment 156, illustrated in FIG. 5, of first convexly curved shell 130. Thus, exterior ends 138 of first and second convexly curved shells 130, 132 are latched when the cantilever snap 154 couples to the compartment 156 and the flat bar 160 of first convexly curved shell 130 overlays the cantilever snap 154.

Operation

To protect the Linkosity™ cables from becoming detached, the lock-on boot 20 is placed around the double-ended cable 12 and the female receptacle 14 such that first pocket 42 supports female receptacle 14 and second pocket 44 supports double-ended cable 12. The retaining rail 24 is lodged in a recess 70 on the double-ended cable 12 between its metal threaded shell and its overmolding. Once the lock-on boot 20 is correctly positioned around the double-ended cable 12 and the female receptacle 14, the first convexly curved shell 30 pivots towards the second convexly curved shell 32, narrowing the open space around the double-ended cable 12 and the female receptacle 14. Hinge 28 allows the first and second convexly curved shells 30, 32 to pivot towards each other and therefore towards the double-ended cable 12 to eventually move into a locking position.

The cover 22 is closed when the first and second convexly curved shells 30, 32 are touching and the mating ends of the locking mechanism 28 are properly matched. At this point, exterior ends 38 are flush against each other and the cantilever snap 54 engages the inlet 56. This creates a snug fit between the first convexly curved shell 30 and the second convexly curved shell 32.

At this point, a padlock 66 loops through first substantially-circular opening 50 on first convexly curved shell 30 and subsequently loops through first substantially-circular opening 50 on second convexly curved shell 32 and locks, thereby securing the lock-on boot 20 to the double-ended cable 12. A tag 68 can be looped through second substantially-circular opening 52 on first convexly curved shell 30 and subsequently loops through second substantially-circular opening 52 on second convexly curved shell 32 and locks, thereby further securing the lock-on boot to the double-ended cable 12 and providing additional information about the system to a user.

Retaining rail 24 prevents the cover 22 from moving up and down the double-ended cable 12 and the female receptacle 14 because it clamps onto and grips the double-ended cable 12 at the intersection of the double-ended cable 12 and the female receptacle 14, once the cover 22 is securely fastened by clamping down on the double-ended cable 12. Further, the thickness of the wall prevents the cover 22 from moving because the cable 12 and the receptacle 14 are each on opposite sides of the retaining rail 24.

To unlock the lock-on boot 20, the padlock 66 and tag 68 are removed from the locking mechanism. A tool, such as a flat-headed screwdriver, is required to dismantle the cantilever snap 54 once it engages the inlet 56. A screwdriver is lodged into the junction between the inlet 56 and the cantilever snap 54 and pries open the first and second convexly curved shells 30, 32. The hinge 28 allows the first and second convexly curved shells 30, 32 to pivot away from each other and therefore away from the double-ended cable 12 therein moving into an open position to free the double-ended cable 12 from the gripping action of the lock-on boot 20.

With the second embodiment, the cantilever snap 154 is locked into the first convexly curved shell 130 after the first and second convexly curved shells 130, 132 are rotated towards each other. Hooks 166 of cantilever snap 154 are squeezed towards the T-bar 158 until they engage the compartment 156. Upon connection, the hooks 166 are released and engage the corners 164 of the inlet 154 while the T-bar 158 rests against the upper wall 162 of compartment 156.

While the invention as illustrated is contemplated to be manufactured of plastic, or an equivalent material thereof, it will be appreciated that the same device could be made of some other insulating material.

When a particular embodiment has been chosen to illustrate the invention, it will be understood by those skilled in the art that various changes and modifications can be made therein without departing from the scope of the invention as defined in the appended claims.

What is claimed is:

1. A lock-on boot comprising:

a cover comprising first and second convexly curved shells and an inner wall, said first and second convexly curved shells having interior ends and exterior ends;

a coplanar retaining rail being mounted on and extending uniformly radially inwardly from said inner wall of said cover, said retaining rail extending within said first and second convexly curved shells for dividing said shells into first and second pockets and extending along an entire arc of said first and second convexly curved shells;

a locking mechanism to secure said first and second convexly curved shells together protruding along exterior ends thereof, said locking mechanism having first substantially-circular opening with a padlock coupled thereto and second substantially-circular opening with a tag coupled thereto; and a hinge extending along said first and second convexly curved shells pivotally joining said interior ends thereof so that said first and second convexly curved shells are movable between open and closed positions.

2. A lock-on boot according to claim 1 wherein a cantilever snap protrudes from said exterior end of said second convexly curved shell.

3. A lock-on boot according to claim 2 wherein said first convexly curved shell comprises an inlet on a surface thereof for receiving said cantilever snap of said second convexly curved shell so that said exterior ends of said first and second convexly curved shells are latched.

4. A lock-on boot according to claim 3 wherein said locking mechanism is adjacent to said cantilever snap.

5. A lock-on boot according to claim 3 wherein said cantilever snap includes a flange for engaging said inlet.

6. A lock-on boot according to claim 2 wherein said first convexly curved shell comprises a compartment on a surface thereof receiving said cantilever snap of said second convexly curved shell to latch said exterior ends of said first and second convexly curved shells.

7. A lock-on boot according to claim 6 wherein said cantilever snap includes a T-bar and at least one hook for engaging said compartment.

8. A lock-on boot according to claim 1 wherein said retaining rail is substantially C-shaped.

9. A lock-on boot according to claim 1 wherein said first pocket of said first convexly curved shell and said first pocket of said second convexly curved shell encase a power receptacle; and said second pocket of said first convexly curved shell and said second pocket of said second convexly curved shell encase a cable adjacent said power receptacle.

10. A lock-on boot according to claim 1 wherein said first substantially-circular openings has a greater radius than said second substantially-circular openings.

11. A lock-on boot according to claim 1 wherein said lock-on boot is comprised of polypropylene.

12. A lock-on boot according to claim 1 wherein said hinge is a living hinge.

13. A lock-on boot according to claim 1 wherein said first convexly curved shell comprises a flat bar on said exterior end bearing an identification label.

14. A lock-on boot according to claim 1 wherein said second convexly curved shell comprises a flat bar on said exterior end bearing an identification label.

15. A lock-on boot comprising:

a cover protecting a cable and a power receptacle adjacent the cable, said cover comprising first and second convexly curved shells and an inner wall, said first and second convexly curved shells having interior ends and exterior ends, said first convexly curved shell comprising an inlet on a surface thereof for receiving a cantilever snap protruding from said exterior end of said second shell so that said exterior ends are latched;

a substantially coplanar C-shaped retaining rail mounted on the inner wall of said cover, extending within said first and second convexly curved shells for dividing said shells into a first pocket for encasing the power receptacle and a second pocket for encasing the cable, said retaining rail extending along an entire arc of and radially uniformly of said first and second convexly curved shells;

a locking mechanism to secure said first and second convexly curved shells together protruding along exterior ends thereof, said locking mechanism comprising a first substantially-circular opening for receiving a padlock and a second substantially-circular opening adjacent said first substantially-circular opening for receiving a tag; and a living hinge extending along said first and second convexly curved shells pivotally joining said interior ends thereof so that said first and second convexly curved shells are movable between open and closed positions.

16. A lock-on boot according to claim 15 wherein said cantilever snap includes a flange for engaging said inlet.

17. A lock-on boot according to claim 15 wherein said lock-on boot is comprised of polypropylene.

18. A lock-on boot comprising:

a cover protecting a cable and a power receptacle adjacent the cable, said cover comprising first and second convexly curved shells, an inner wall, said first and second convexly curved shells having interior ends and exterior ends, said first convexly curved shell comprising a compartment on a surface thereof for receiving a cantilever snap protruding from said exterior end of said second shell so that said exterior ends are latched;

a substantially coplanar C-shaped retaining rail mounted on the inner wall of said cover, extending within said first and second convexly curved shells for dividing said shells into a first pocket for encasing the power receptacle and a second pocket for encasing the cable, said retaining rail extending along an entire arc of and radially uniformly of said first and second convexly curved shells;

a locking mechanism to secure said first and second convexly curved shells together protruding along exterior ends thereof, said locking mechanism comprising a first substantially-circular opening for receiving a padlock and a second substantially-circular opening adjacent said first substantially-circular opening for receiving a tag; and a living hinge extending along said first and second convexly curved shells pivotally joining said interior ends thereof so that said first and second convexly curved shells are movable between open and closed positions.

19. A lock-on boot according to claim 18 wherein said cantilever snap includes a T-bar and at least one hook engaging said compartment.

* * * * *